US007311610B2

(12) United States Patent
Ochi

(10) Patent No.: US 7,311,610 B2
(45) Date of Patent: Dec. 25, 2007

(54) PLAY FACILITY

(75) Inventor: Yasushi Ochi, Izumisano (JP)

(73) Assignee: BLD Oriental Co., Ltd., Izumisano-shi (JP)

( * ) Notice: Subject to any disclaimer, the term of this patent is extended or adjusted under 35 U.S.C. 154(b) by 354 days.

(21) Appl. No.: 10/505,123

(22) PCT Filed: Feb. 10, 2003

(86) PCT No.: PCT/JP03/01400

§ 371 (c)(1),
(2), (4) Date: Aug. 19, 2004

(87) PCT Pub. No.: WO03/070345

PCT Pub. Date: Aug. 28, 2003

(65) Prior Publication Data

US 2005/0166474 A1 Aug. 4, 2005

(30) Foreign Application Priority Data

Feb. 20, 2002 (JP) ..... 2002-043182

(51) Int. Cl.
*A63G 31/12* (2006.01)

(52) U.S. Cl. ..... 472/134; 472/136; 273/129 AP

(58) Field of Classification Search ..... 472/68, 472/134, 136; 273/129 AP, 457, 458
See application file for complete search history.

(56) References Cited

U.S. PATENT DOCUMENTS 6,364,782 B1 * 4/2002 Ochi ..... 472/134
6,511,382 B1 * 1/2003 Ochi ..... 472/134
6,739,876 B2 * 5/2004 Ochi ..... 434/258

FOREIGN PATENT DOCUMENTS

| | | | |
|---|---|---|---|
| JP | H07-009395 | A | 2/1995 |
| JP | H09-182877 | A | 7/1997 |
| JP | 3068842 | U | 3/2000 |
| JP | 2001-341838 | A | 12/2001 |

* cited by examiner

*Primary Examiner*—Kien Nguyen
(74) *Attorney, Agent, or Firm*—Judge Pat. Assoc.

(57) ABSTRACT

Play facility that lets play participants experience visual stimulation, and with which a decorative effect can be attained. The play facility includes a frame, partition members attached to the frame and forming a play space, a gas-filled transparent tubular member that is arranged within the play space at the bottom of the facility, an air-filled air mat that is enclosed by the tubular member, a pressurizing device for filling the inside of the tubular member and the air mat with air to increase their internal pressures, an air-flow generation device for causing air within the tubular member to flow in one direction, and balloons accommodated within the tubular member and caused to flow and circulate within the tubular member by the airflow generated by the airflow generation device. Play participants can step onto the tubular member or the air-mat and feel their elasticity, and by seeing the balloons flowing and circulating inside the tubular member, they can experience visual stimulation.

9 Claims, 9 Drawing Sheets

PLAY FACILITY

TECHNICAL FIELD

The present invention relates to play facilities intended mainly for little children and that can be set up in amusement parks, department stores, or supermarkets.

BACKGROUND ART

Various conventional play facilities of the above-noted kind are known, in which the play participants play within a predetermined play space that is partitioned by partition members. For example, one known play facility includes pillars erected at four corners, net-like partition members stretched out between the pillars, and an air-mat or the like arranged at the bottom within the play space enclosed by the partition members.

In such play facilities, a play participant such as a child rides on the air-mat and can enjoy playing on the air-mat while experiencing its elasticity by moving or jumping around on the air-mat. The partitioning with the partition members prevents children playing on the mat from inadvertently jumping outside.

However, with the above-described play facility, even though the play participants can enjoy the mat's elasticity by moving about or jumping and bouncing on the mat, their visual interest is not stimulated. Decorative devices to attract the attention of the play participants for the most part have been limited to static materials such as pictures or photos attached to the partition members, and thus have not left a strong impression on the viewers nor been very attention-getting.

In view of the above circumstances, it is an object of the present invention to make available a play facility that allows play participants to be given a real sense of visual interest and enables ornamental effectiveness.

DISCLOSURE OF INVENTION

In order to attain the above-noted objects, a play facility according to the present invention comprises partition members forming a play space that is partitioned from an outside space and configured such that a play participant can play within the play space, an gastight tubular member filled with a gas, the tubular member being made of a pliant transparent sheet member shaped into a tubular loop form; a pressurizing means for filling the tubular member with a gas and increasing its internal pressure; a gas-flow generation means for letting the gas inside the tubular member flow in one direction; and a plurality of flowing members accommodated inside the tubular member and caused to flow inside the tubular member by the gas flow generated by the gas-flow generation means.

With this invention, first the pressurizing means fills the tubular member with gas and increases its internal pressure, the tubular member expands, and assumes a state in which it exhibits elasticity. Thus, play participants or the like can step onto the tubular member and jump around or sit on the tubular member, experiencing its elasticity.

When the tubular member is filled with a gas, then the gas-flow generation means causes the gas inside the tubular member flow in one direction, and the plurality of flowing members accommodated inside the tubular member are caused to flow and circulate inside the tubular member by the gas flow. The play participants can see the flowing members that flow and circulate inside the tubular member through the transparent sheet member, and experience this visual stimulation.

The tubular member accommodating the flowing members inside may be arranged at least at one location selected from a bottom portion inside the play space, a top portion inside the play space, a location above the partition members and the circumferential periphery of the partition members. In this case, the pressurizing means and the gas-flow generation means may be provided separately for each of the tubular members, or one set of pressurizing means and gas-flow generation means may be provided for all tubular members. When a tubular member is arranged at the upper portion of the play space or around the partition members, then a decorative effect can be attained by the flowing members that flow and circulate inside the tubular member.

The tubular member may be arranged at a bottom portion inside the play space, an gastight pouchlike member made of a sheet member similarly being pliant may be arranged to the inside of the tubular member loop, an internal space of this pouchlike member being in communication with an internal space of the tubular member, and the pressurizing means may fill the gas into the tubular member and the pouchlike member, and increase their internal pressure.

Thus, the pressurizing means fills both the tubular member and the pouchlike member with the gas, they expand and assume a state in which they exhibit elasticity, and play participants can step onto the tubular member and the pouchlike members, and jump around on them, experiencing their elasticity.

As long as the gas-flow generation means generates a gas flow inside the tubular member, it may have any configuration, for example it may be a fan or a blower, and it may be disposed inside the tubular member.

Alternatively, the gas-flow generation means may be disposed outside the tubular member in a vicinity thereof. In this case, the gas-flow generation means includes a suction port for sucking in gas, and a discharge port for discharging gas that has been sucked in and pressurized, whereas the tubular member is provided with a gas outflow port and a gas inflow port, the gas outflow port being connected to the suction port of the gas-flow generation means, and the gas inflow port being connected to the discharge port of the gas-flow generation means, and the gas inside the tubular member is fed to the gas-flow generation means through the gas outflow port and pressurized, and the pressurized gas is fed into the tubular member through the gas inflow port, so that the gas inside the tubular member flows in said one direction.

Furthermore, in the above-noted case, the gas outflow port and the gas inflow port may be arranged close to one another, the gas outflow port being arranged upstream and the gas inflow port being arranged downstream within the tubular member. Alternatively, the gas outflow port and the gas inflow port may be disposed above one another, with the gas outflow port being disposed at the top and the gas inflow port being disposed at the bottom.

Also, in the above-noted case, it is preferable that the gas outflow port is provided with an adsorption prevention member, which is a member having a multitude of through holes and provided with a shape that bulges from the gas outflow port into the space inside the tubular member. Thus, the gas outflow port is covered by the inward-protruding adsorption prevention member, so that flowing members flowing and circulating through the tubular member do not easily stick to gas outflow port, and it can be prevented that some of the flowing members stick to the gas outflow port and impede the flow of the other flowing members, or that the volume of gas flowing through the gas inflow port is reduced.

The flowing members that are caused to flow and circulate inside the tubular member tend to rub against one another and when they are charged with static electricity, the flowing members may attract each other and stick together, impeding their ability to flow, or in extreme cases even clogging the inside of the tubular member.

In this case, a humidifying means for humidifying the inside of the tubular member should be provided. Thus, the inside of the tubular member is humidified, the static electricity on the flowing members is eliminated, and the flowing members can be caused to flow and circulate with verve over long periods of time.

The humidifying means may be made of a water holding means provided inside the tubular member and a water supply means for supplying water to the water holding means. Thus, static electricity can be eliminated from the flowing members flowing and circulating through the tubular member as the flowing members come in contact with the water holding means or with the moisture evaporating from the water holding means.

The water holding means may be a sponge, and the water supply means may be configured with a tank storing water, and a pump for supplying the water from the tank to the water holding means, for example.

For the sheet member, a sheet made of a synthetic resin, such as nylon or vinyl may be used, and for the partition members, nets made of natural or synthetic fibers may be used. Also, examples of the flowing members are balloons, such as rubber balloons, flowing members made of foamed styrene or ping-pong balls, and they can be provided with various shapes and colors.

BRIEF DESCRIPTION OF DRAWINGS

Furthermore.

BEST MODE FOR CARRYING OUT THE INVENTION

Figure 1:
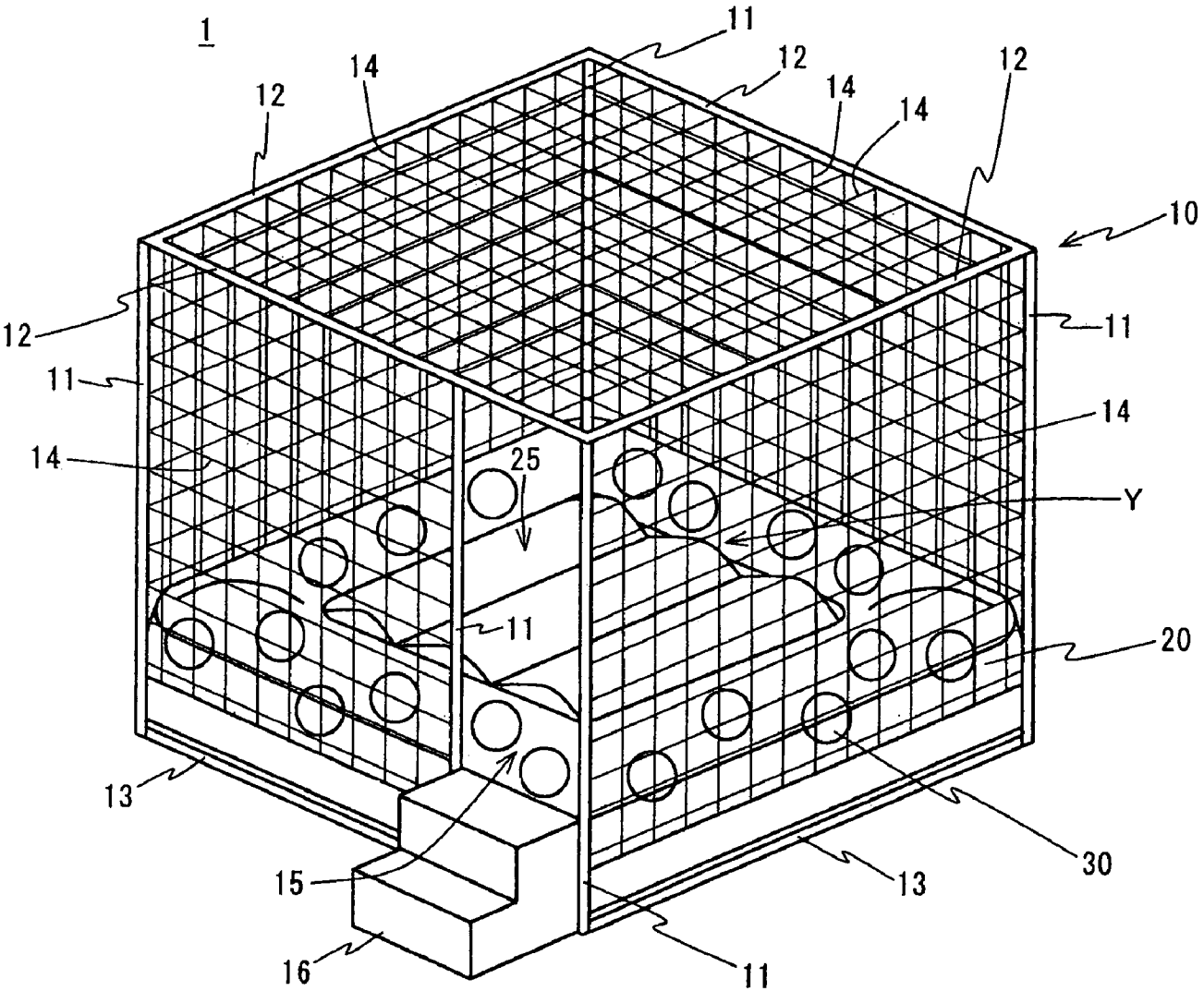
FIG. 1 is an isometric view showing the overall configuration of a preferred play facility according to the present invention.
Figure 2:
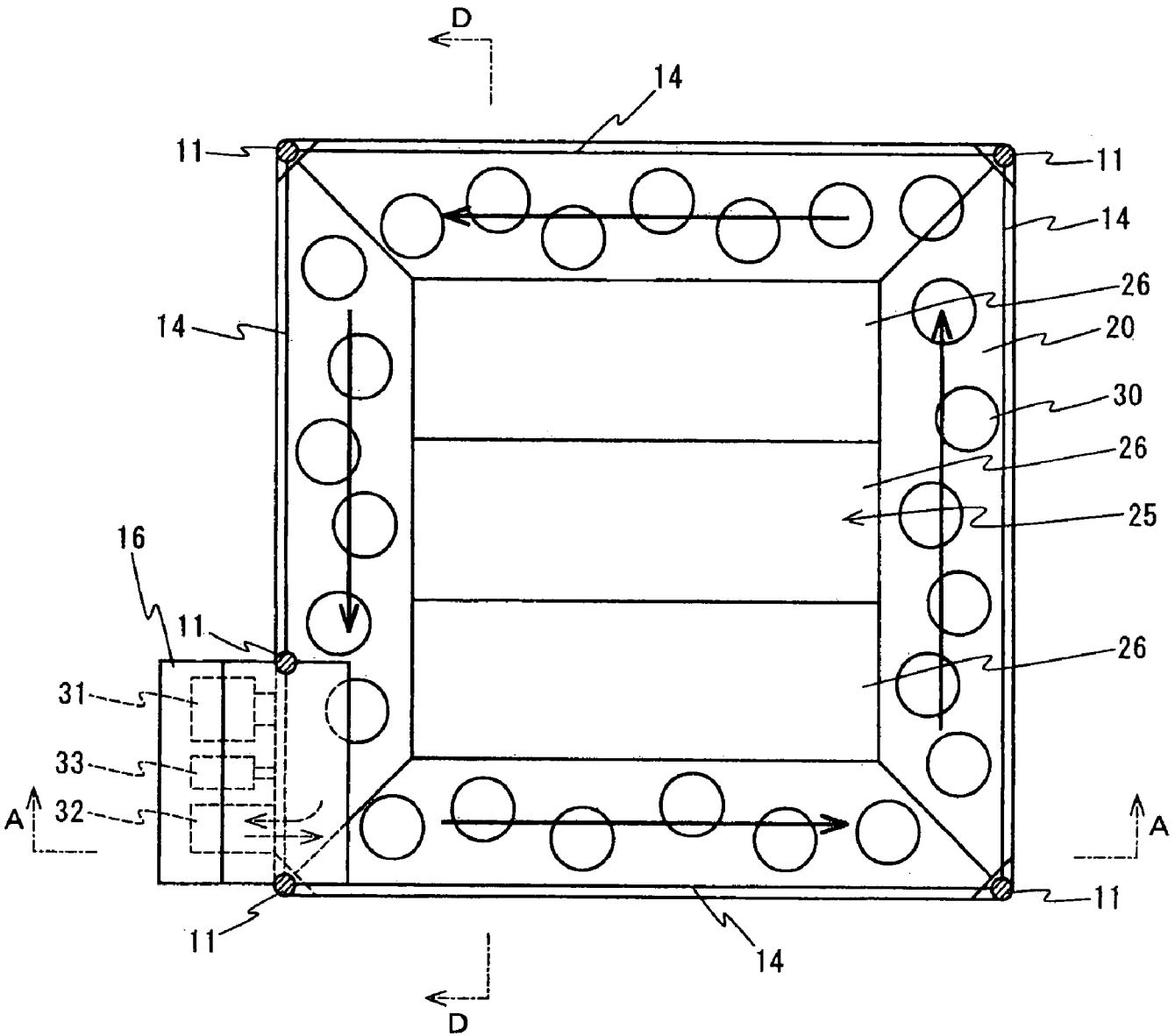
FIG. 2 is a plan view showing this play facility, in a section taken along view-directing B-B in FIG. 3.
Figure 3:
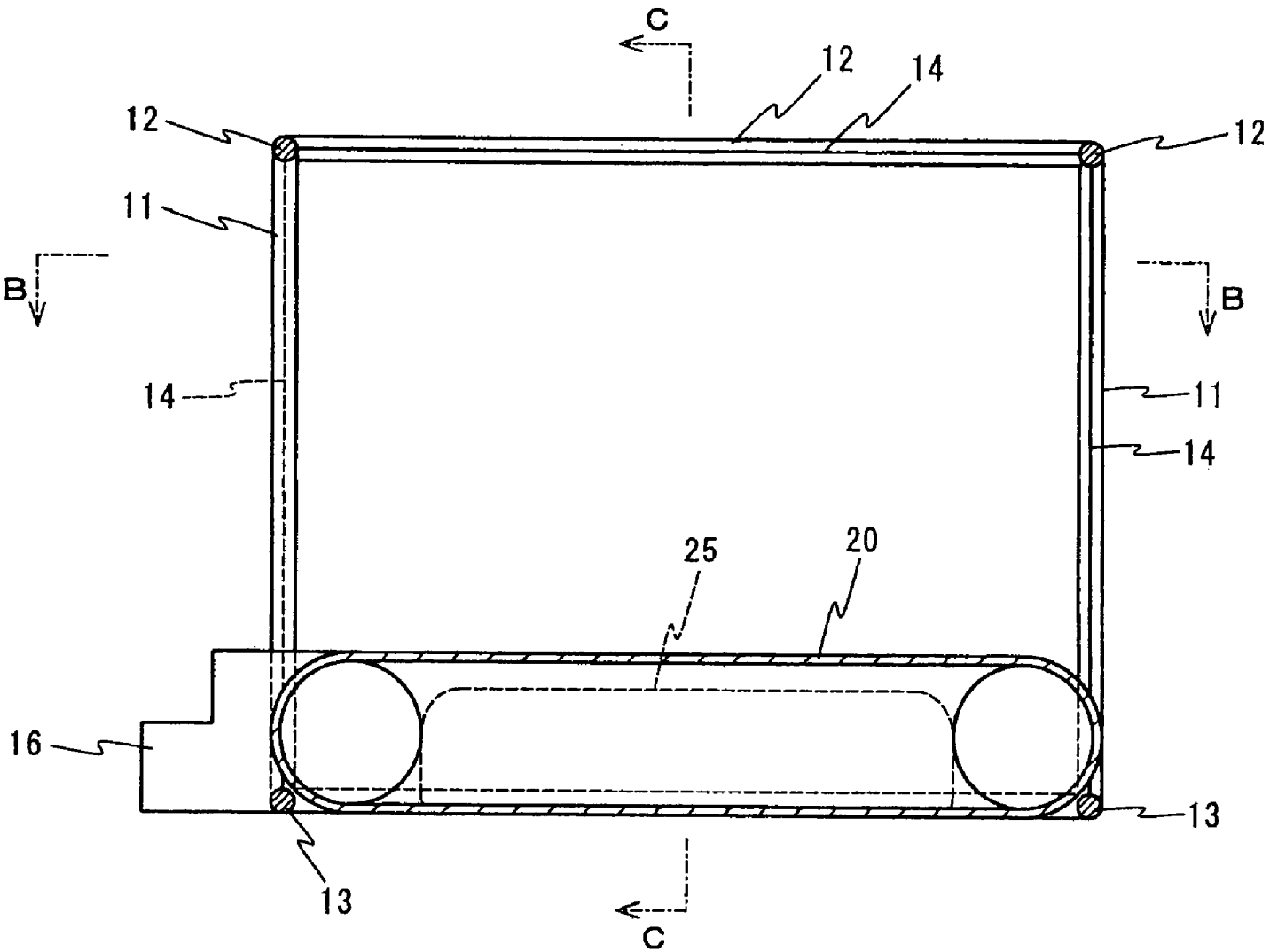
FIG. 3 is a elevation view in a section taken along view-directing A-A in FIG. 2.
Figure 4:
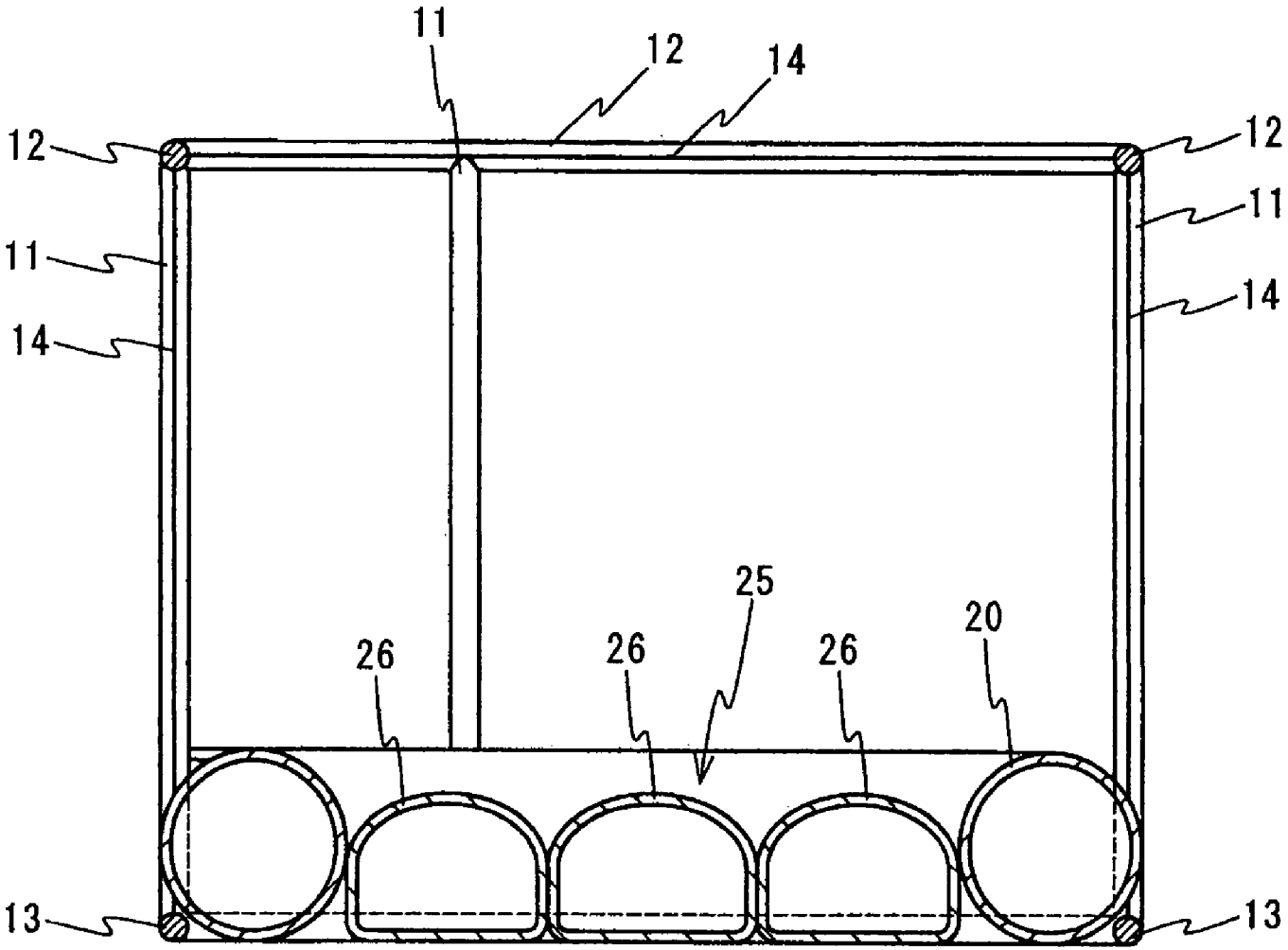
FIG. 4 is a side view in a section taken along view-directing C-C in FIG. 3.

The following is a more detailed explanation of the present invention, with reference to the accompanying drawings.

As shown in FIGS. 1 to 4, a play facility 1 of this example includes a frame 10, partition members 14 attached to the frame 10 and forming a predetermined play space Y, a tubular member 20 filled with air that is arranged at the bottom within the play space Y, an air-mat 25 filled with air that is arranged at the center at the bottom within the play space Y and enclosed by the tubular member 20, a plurality of balloons 30 accommodated within the tubular member 20, a pressurizing means 31 for filling the inside of the tubular member 20 and the air-mat 25 with air and increasing their internal pressure, a gas-flow generation means 32 for letting air within the tubular member 20 flow in one direction, and a humidifying means 33 for humidifying the inside of the tubular member 20. Moreover, this play facility 1 is provided with an entrance 15 through which play participants can enter or leave the play space Y, and steps 16.

The frame 10 is made of pole members 11, girder members 12 and bottom side members 13, as well as joints (not shown in the drawings) for linking these together in a deconstructable manner. The pole members 11, the girder members 12 and the bottom side members 13 are each made of a thin-walled pipe made of steel or aluminum, a shock-absorbing material such as a urethane sponge wound around the outer circumferential surface of the thin-walled pipe, and a vinyl sheet covering this shock-absorbing member.

The partition members 14 are, for example, formed of nets made of natural or synthetic fibers, and are arranged at the portions corresponding to the four lateral sides (except for the entrance 15) of the play space Y and the upper side of the play space Y. It should be noted that the partition members 14 are attached at their periphery to the frame 10 in a removable manner by fastening means (not shown in the drawings) such as zippers or Velcro™.

The tubular member 20 is shaped into a tubular loop form (rectangular in plan view) from a transparent sheet member made of a synthetic resin, such as nylon or vinyl, for example. The tubular member 20 is formed gastight, and attached at its outer periphery to the partition members 14 and the bottom side members 13 in a removable manner with fastening means (not shown in the drawings) such as zippers or Velcro™.

The air-mat 25 is made by connecting three tubular members 26 such that their inner spaces are linked to one another. Each of the tube members 26 is made gastight from a transparent sheet member made of a synthetic resin, such as nylon or vinyl, for example, and linked to the tubular member 20 such that its inside is in communication with the inside of the tubular member 20.

The pressurizing means 31 is constituted from a blower or the like, which is connected to the circumferential periphery of the tubular member 20, supplies air into the tubular member 20, and raises the air pressure inside the tubular member 20 to a predetermined pressure. It should be noted that, as pointed out above, the inside of the tubular member 20 is in communication with the inside of the air-mat 25, so that the air that is supplied from the pressurizing means 31 also flows from the tubular member 20 to the air-mat 25, pressurizing the inside of the air-mat 25 together with the tubular member 20.

Moreover, the humidifying means 33 is constituted from a humidifier connected to the circumferential periphery of the tubular member and that supplies steam to the inside of the tubular member 20, thus humidifying the inside of the tubular member 20.

Figure 5:
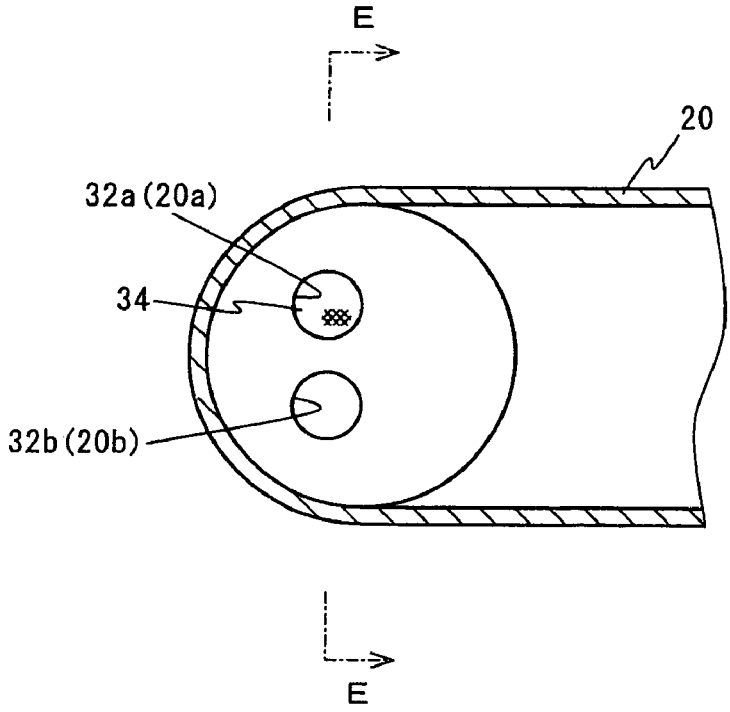
FIG. 5 is a fragmentary section taken along view-directing D-D in FIG. 2.
Figure 6:
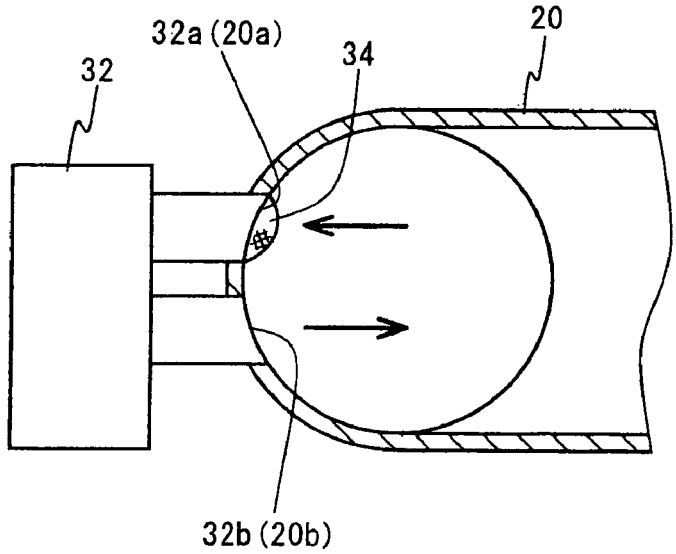
FIG. 6 is a fragmentary section taken along view-directing E-E in FIG. 5.

The gas-flow generation means 32 is constituted from a blower or the like, and, as shown in FIGS. 5 and 6, is provided with a suction port 32*a* for sucking in air and a discharge port 32*b* for discharging air that has been sucked in and pressurized. The suction port 32*a* is connected to a gas outflow port 20*a* formed in the tubular member 20, whereas the discharge port 32*b* is similarly connected to a gas inflow port 20*a* formed in the tubular member 20. The air inside the tubular member 20 flows from the gas outflow port 20*a* into the gas-flow generation means 32, is pressurized, and the pressurized air is fed through the gas inflow port 20*b* into the tubular member 20. Through this operation, the air inside the tubular member 20 is caused to flow in the direction indicated by the arrows in FIG. 2.

Moreover, the suction port 32*a* and the gas outflow port 20*a* on the one hand and the discharge port 32*b* and the gas inflow port 20*b* on the other hand are arranged above one another, with the suction port 32*a* and the gas outflow port 20*a* being arranged on top and the discharge port 32*b* and the gas inflow port 20*b* being arranged below that.

Furthermore, the gas outflow port 20*a* (suction port 32*a*) is provided with an adsorption prevention member 34, which is a member provided with a multitude of through holes and having a (semispherical) shape that bulges from the gas outflow port 20*a* into the space inside the tubular member 20.

Moreover, the suction port 32*a*, the gas outflow port 20*a*, the discharge port 32*b* and the gas inflow port 20*b* are arranged at a corner of the tubular member 20, when viewed from above, so that the direction of the air flow from the discharge port 32*b* (gas inflow port 20*b*) into tubular member 20 is aligned with one side of the tubular member 20.

A space is provided inside the steps 16, and the pressurizing means 31, the gas-flow generation means 32 and the humidifying means 33 are accommodated inside this internal space. Moreover, the steps 16 are covered by a shock-absorbing material, such as urethane sponge, and the shock-absorbing member is furthermore covered by a vinyl sheet or the like. This shock-absorbing member has the function of absorbing shocks and preventing a play participant from getting bruised if he or she should fall down, and also functions to reduce noise, so that the operating noise of the pressurizing means 31, the gas-flow generation means 32 and the humidifying means 33 does not escape outside.

With the play facility 1 of the example configured as described above, first, the pressurizing means 31 supplies air into the tubular member 20. Thus, air is filled into the tubular member 20 and the air-mat 25, whose internal pressure is raised to a predetermined pressure, and the tubular member 20 and the air-mat 25 expand, assuming an elastic state. Thus, a play participant can step onto the tubular member 20 and the air-mat 25 in this state, and can enjoy experiencing the mat's elasticity by jumping and bouncing on the mat.

After the inside of the tubular member 20 and the air-mat 25 have been pressurized to a certain pressure, it is possible to either keep supplying air with the pressurizing means 31 or to seal the supply portion shut, in order to sustain the pressure.

After this, the gas-flow generation means 32 is driven, the air inside the tubular member 20 flows into the gas-flow generation means 32 through the gas outflow port 20*a* (suction port 32) and is pressurized, and the pressurized air is ejected through the gas inflow port 20*b* (discharge port 32*b*) into the tubular member 20. This operation generates an air flow that lets the air inside the tubular member 20 flow and circulate in the direction of the arrows in FIG. 2. Thus, with this generated air flow, the plurality of balloons 30 accommodated inside the tubular member 20 are caused to flow and circulate inside the tubular member 20, and viewing the balloons 30 from the outside, the visual interest of the play participants is stimulated.

It should be noted that when the gas inflow port 20*b* (discharge port 32*b*) and the gas outflow port 20*a* (suction port 32*a*) are arranged at a distance from one another, then the air flow inside the tubular member 20 will weaken between the gas inflow port 20*b* (discharge port 32*b*) and the gas outflow port 20*a* (suction port 32*a*), which may compromise the flow properties of the balloons 30 or make it impossible to let the balloons 30 flow with verve, thus diminishing the above-noted visually stimulating effect.

In this example, the gas inflow port 20*b* (discharge port 32*b*) and the gas outflow port 20*a* (suction port 32*a*) are arranged close together, and moreover arranged on top of one another, so that the air flow in the tubular member 20 between the gas inflow port 20*b* (discharge port 32*b*) and the gas outflow port 20*a* (suction port 32*a*) is not weakened, and the balloons 30 are vigorously circulated. Also, gravity tends to pull the balloons 30 to the bottom inside the tubular member 20, but since the gas inflow port 20*b* (discharge port 32*b*) is arranged at the bottom, the air flow discharged from the gas inflow port 20*b* (discharge port 32*b*) directly hits the balloons 30 which tend to be located at the bottom, and also in this regard the balloons 30 can be vigorously circulated.

Moreover, if nothing is provided at the gas outflow port 20*a* (suction port 32*a*), then it may occur that a balloon 30 is sucked against the gas outflow port 20*a* (suction port 32*a*), closing it and extinguishing the air flow within the tubular member 20, but in the present example, the adsorption prevention member 34 with the above-noted shape is provided at the gas outflow port 20*a* (suction port 32*a*), so that it does not occur that the gas outflow port 20*a* (suction port 32*a*) is closed shut by the balloons 30, and stable flow of the balloons 30 can be ensured.

Furthermore, the balloons 30 that are caused to flow and circulate inside the tubular member 20 tend to rub against one another and be charged with static electricity, and when they are charged with static electricity, the balloons 30 may attract each other and stick together, impeding their ability to flow, or in extreme cases even clogging the inside of the tubular member.

In the present example, the humidifying means 33 is arranged inside the tubular member 20, so that the inside of the tubular member 20 is humidifyied by this humidifying means 33, eliminating the static electricity that has formed on the balloons 30, so that long-term vigorous flow and circulation of the balloons 30 can be ensured.

Moreover, shock-absorbing material is wound around the pillar members 11 and the girder members 12, so that if children playing inside the play space Y accidentally hit the pillar members 11 or girder members 12, then the shock of the collision is absorbed by the shock-absorbing members, effectively preventing the play participants from hurting themselves.

The foregoing is an explanation of an embodiment of the present invention, but specific forms that can be adopted for the present invention are not limited to the above configuration.

Figure 7:
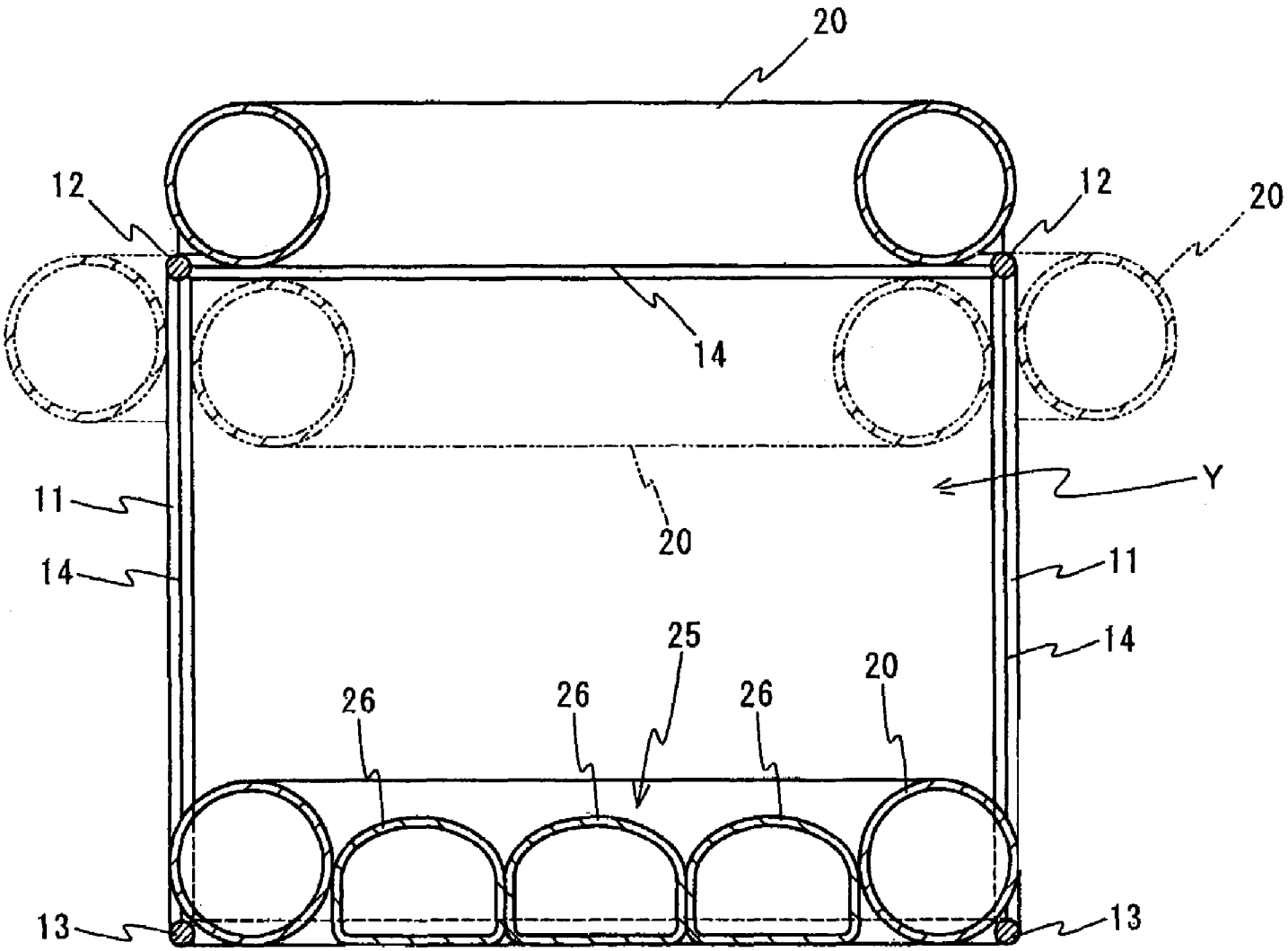
FIG. 7 is a sectional view showing the overall configuration of another preferred play facility according to the present invention.

For example, as shown in FIG. 7, the tubular member 20 may be provided not only at the bottom inside the play space Y, but also on top of the play space Y Thus, the balloons 30, which flow and circulate inside the tubular member 20 provided on top of the play space Y, can be observed from the play space Y and from the outside, and their decorative effect can be enhanced. In this case, the pressurizing means 31 and the gas-flow generation means 32 may be provided separately for each of the tubular members 20, or one set of pressurizing means 31 and gas-flow generation means 32 may be provided for both tubular members 20.

The location where the tubular member 20 is arranged in order to attain the above-noted decorative effect is not limited to the top of the play space Y, and the tubular member 20 may also be provided around the play space Y or at an upper portion within the play space Y.

Figure 8:
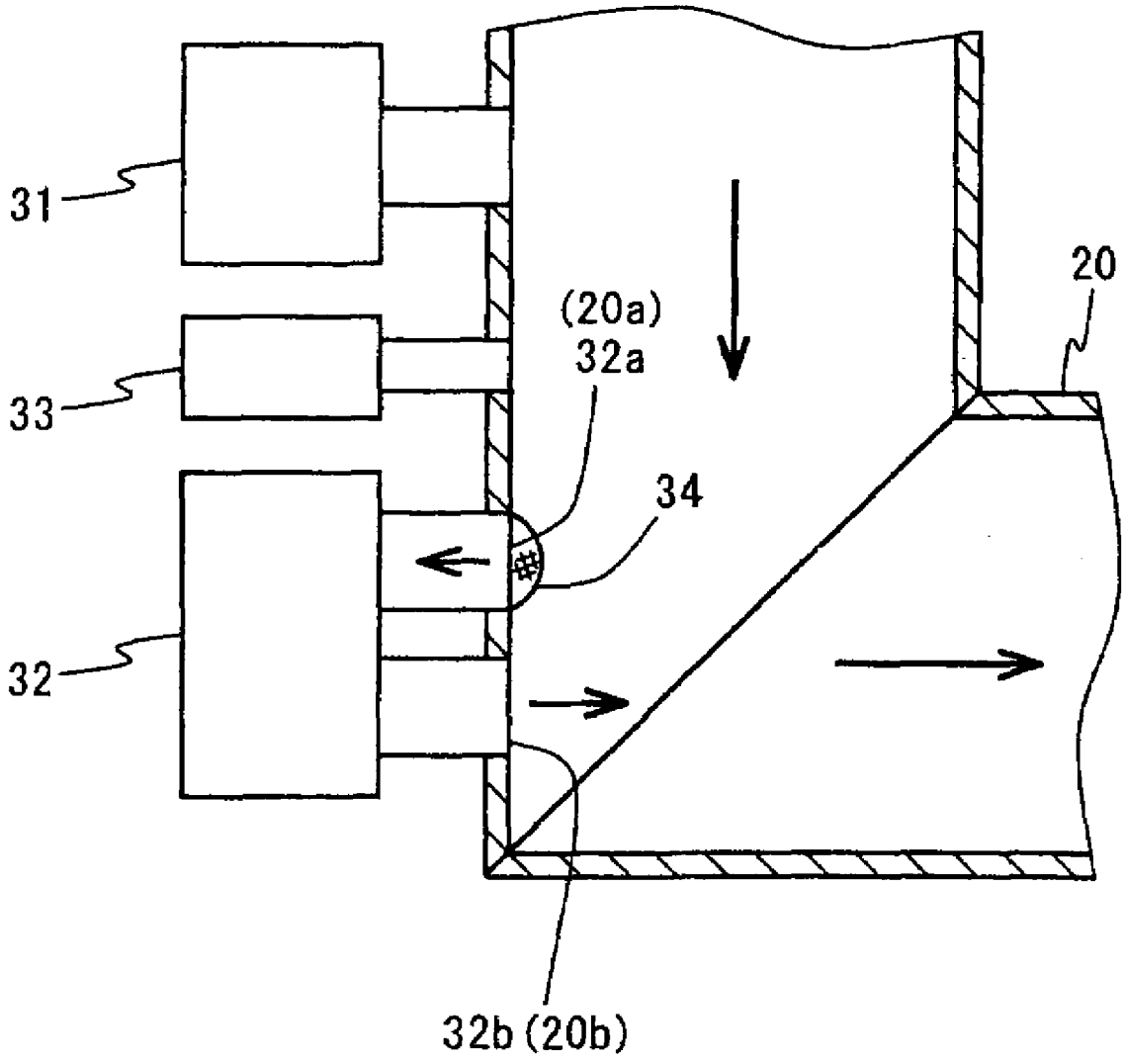
FIG. 8 is a sectional plan view fragmentarily showing yet another preferred play facility according to the present invention.

Also, there is no particular limitation regarding the shape of the tubular member 20, as long as the balloons 30 can flow and circulate within the tubular member 20. Moreover, the gas inflow port 20*b* (discharge port 32*b*) and the gas outflow port 20*a* (suction port 32*a*) were arranged above one another, but there is no limitation to this, and it is also possible to arrange the gas outflow port 20*a* (suction port 32*a*) at an upstream location and the gas inflow port 20*b* (discharge port 32*b*) at a downstream location within the tubular member 20, as shown in FIG. 8. However, for the above-noted reasons, it is preferable that they are arranged close to one another.

Figure 9:
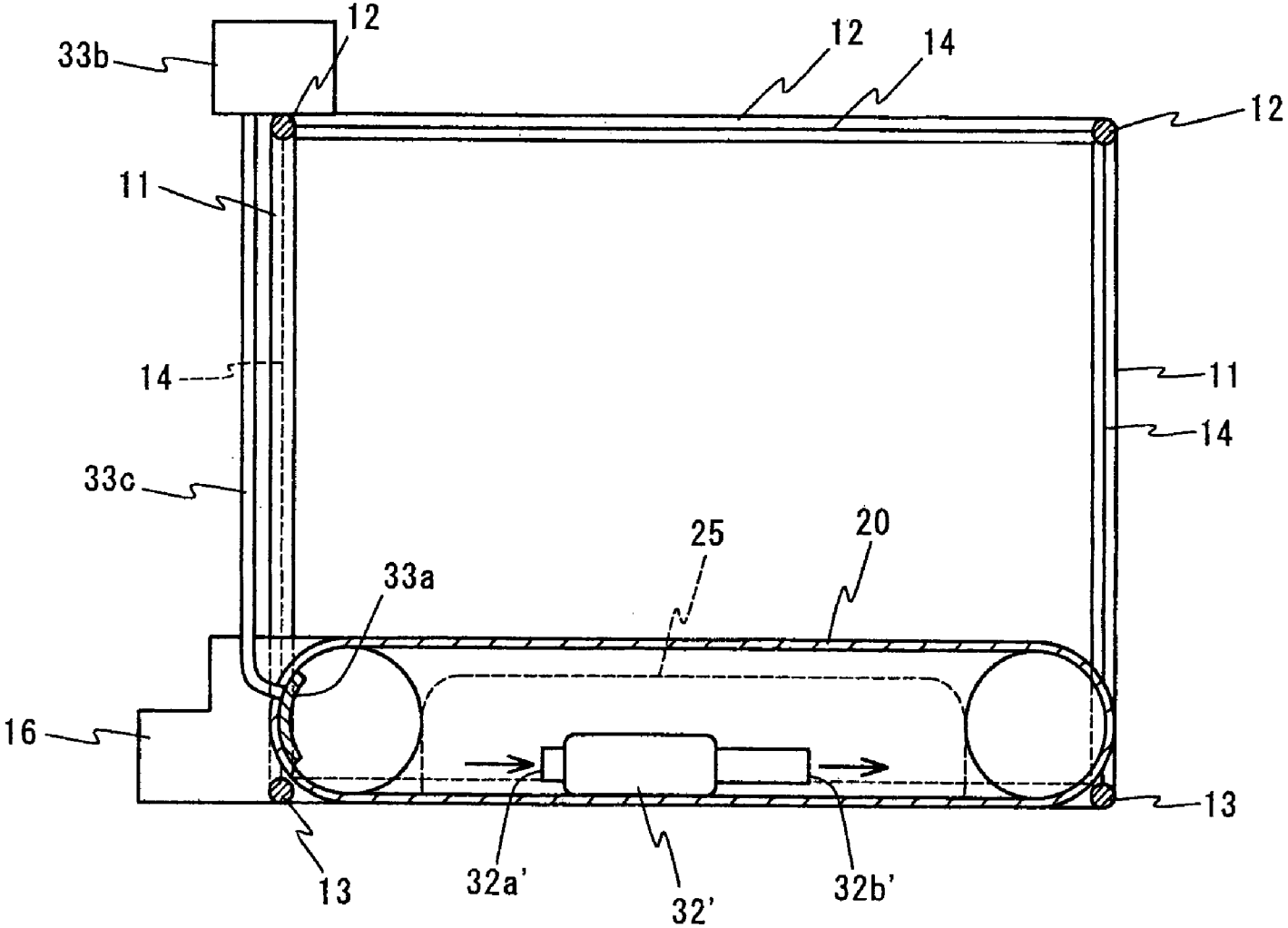
FIG. 9 is a sectional elevation view showing the overall configuration of still another preferred play facility according to the present invention.

Moreover, the gas-flow generation means 32 was arranged outside the tubular member 20, but there is no limitation to this, and it is also possible to arrange a gas-flow generation means 32' within the tubular member 20, as shown in FIG. 9. In FIG. 9, reference numeral 32*a*' denotes a suction port and reference numeral 32*b*' denotes a discharge port.

Moreover, as shown in FIG. 9, the humidifying means 33 may also be made of a water holding means 33*a* disposed inside the tubular member 20 and a water supply means supplying water to this water holding means 33*a*. Thus, static electricity on the balloons 30 circulating inside the tubular member 20 is eliminated as the balloons 30 come in contact with the water holding means 33*a* or with the moisture evaporating from the water holding means 33*a*.

An example of the water holding means 33*a* is a sponge, and an example of the water supply means is a configuration made of a tank 33*b* storing water, and a pump for supplying the water from the tank 33*b* to the water holding means 33*a*. Furthermore, in this case, if the tank 33*b* is arranged at a high location, such as above the girder members 12, and water is supplied from the tank 33*b* via a water supply pipe 33*c* to the water holding means 33*a*, then the water is supplied to the water holding means 33*a* through the water pressure, so that there is no particular need to install a pump.

Figure 10:
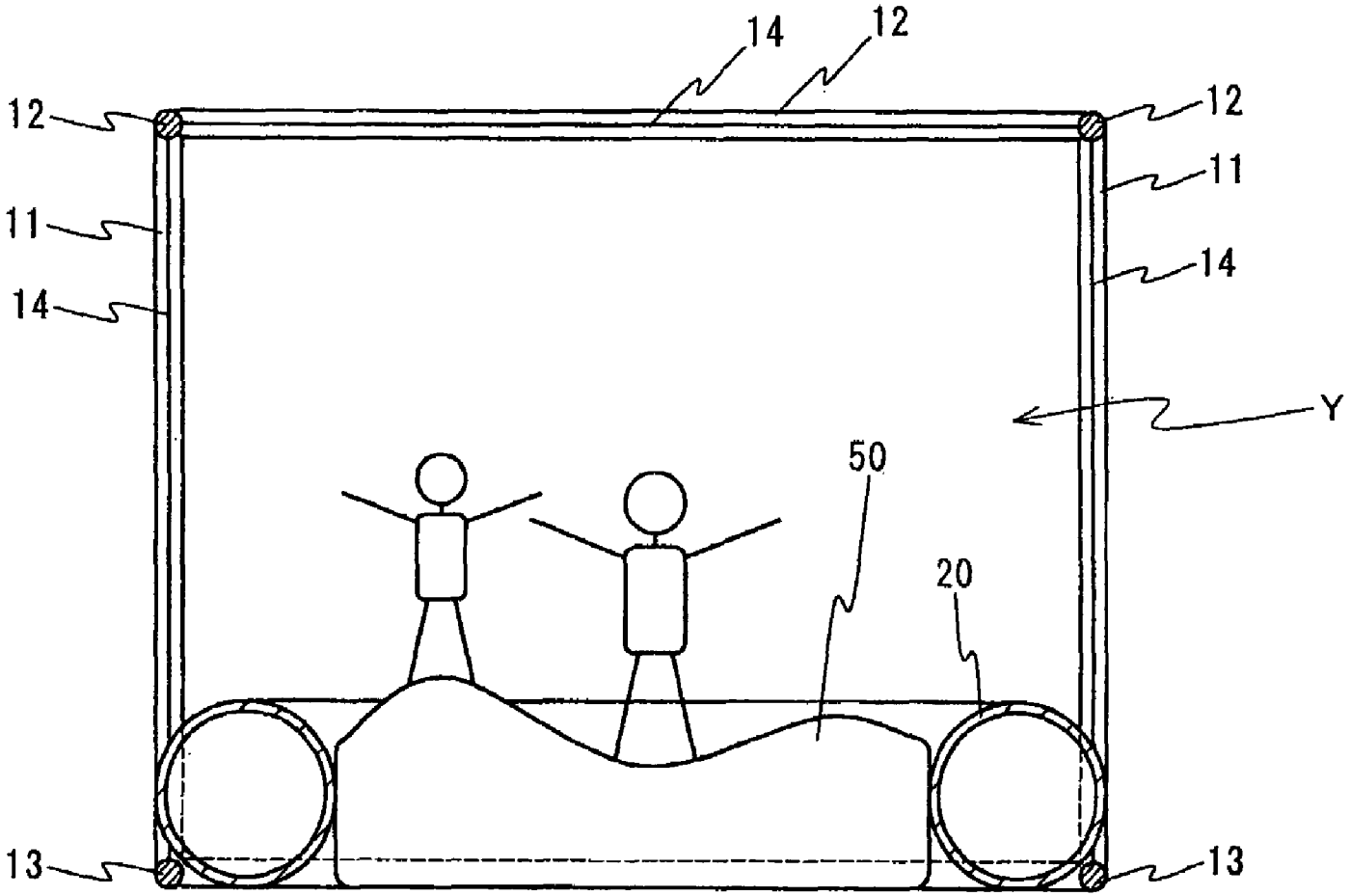
FIG. 10 is a sectional view showing the overall configuration of yet a further preferred play facility according to the present invention.

Also, in the foregoing example, an air-mat 25 was placed in the center at the bottom of the play space Y, surrounded by the tubular member 20, but there is no limitation to this, and as shown in FIG. 10, it is also possible to place a mat 50 filled with a liquid and made of a sheet member formed into an gastight pouch, in the center at the bottom of the play space Y Thus, it becomes possible to experience different sensations than with the air-mat 25.

Instead of the mat 50, it is also possible to provide a ball pool in the region enclosed by the tubular member 20 and accommodating a multitude of balls, or to provide smaller versions of the tubular 20 in a concentric arrangement. Thus, by arranging various members and contrivances in the region enclosed by the tubular member 20, it is possible to provide a variety of play options.

Also, for the balloons 30, it is possible to use balloons of various shapes, patterns and colors. Moreover, there is no limitation to balloons 30, and it is possible to use anything that can be circulated by a gas flow, such as foamed styrene or ping-pong balls.

INDUSTRIAL APPLICABILITY

As explained in the foregoing, a play facility according to the present invention can be installed in amusement parks, department stores or supermarkets, and is mainly suitable as a play facility for children.

The invention claimed is:

1. A play facility comprising:

partition members for forming a play space partitioned from an external space and configured to let play participants play within the play space;

an approximately horizontally oriented, elastic tubular member shaped into a tubular loop form from a pliant transparent sheet material and formed to be gastight, said tubular member being interiorly filled with gas and being arranged in a bottom region inside the play space;

a pouchlike member, formed similarly to said tubular member of a pliant sheet material and to be gastight, arranged to the inside of the tubular member loop, the internal space of said pouch-like member being communicated with the internal space of said tubular member;

a pressurizing means for charging said tubular member and said pouch-like member internally with gas to elevate their internal pressure, so as to render both said tubular member as well as said pouch-like member weight bearing/impact resistant;

a gas-flow generation means for unidirectionally flowing the gas inside said tubular member; and a plurality of elastic flowing members accommodated inside said tubular member, for being caused to flow inside said tubular member by the gas flow generated by said gas-flow generation means, whereby players can experience, through said tubular member, the elasticity of said flowing members.

2. The play facility according to claim 1, further comprising at least one other tubular member similar to said tubular member as accommodating flowing members, said one other tubular member being arranged in at least in one location among: a top region inside the play space, above said partition members, and peripherally around said partition members.

3. The play facility according to claim 1, wherein said gas-flow generation means is disposed inside said tubular member.

4. The play facility according to claim 1, wherein:

said gas-flow generation means includes a suction port for sucking in gas, and a discharge port for discharging gas that has been sucked in and pressurized, and said gas-flow generation means is disposed externally to and in the vicinity of said tubular member;

said tubular member is provided with a gas outflow port and a gas inflow port, said gas outflow port being connected to said suction port of said gas-flow generation means, and said gas inflow port being connected to said discharge port of said gas-flow generation means; and the gas inside said tubular member is fed to said gas-flow generation means through said gas outflow port and pressurized, and the pressurized gas is fed into said tubular member through said gas inflow port, so as to flow in said one direction the gas inside said tubular member.

5. The play facility according to claim 4, wherein said gas outflow port and said gas inflow port are arranged close to one another, said gas outflow port being arranged upstream and said gas inflow port being arranged downstream within said tubular member.

6. The play facility according to claim 4, wherein said gas outflow port and said gas inflow port are ranged vertically in line, with the gas outflow port being disposed above and the gas inflow port being disposed below.

7. The play facility according to claim 4, wherein said gas outflow port is provided with an adsorption prevention member, being a component having numerous through-holes and lent a form bulging from said gas outflow port into the space inside said tubular member.

8. The play facility according to claim 1, further comprising a humidifying means for humidifying the interior of said tubular member.

9. The play facility according to claim 8, wherein said humidifying means comprises a water holding means provided inside said tubular member and a water supply means for supplying water to said water holding means.

* * * * *